US009901756B1

(12) United States Patent
Roberts

(10) Patent No.: US 9,901,756 B1
(45) Date of Patent: Feb. 27, 2018

(54) FIRE ESCAPE DEVICE FOR A BABY HARNESS

(71) Applicant: Lezlie Roberts, Douglasville, GA (US)

(72) Inventor: Lezlie Roberts, Douglasville, GA (US)

( * ) Notice: Subject to any disclaimer, the term of this patent is extended or adjusted under 35 U.S.C. 154(b) by 37 days.

(21) Appl. No.: 15/132,335

(22) Filed: Apr. 19, 2016

(51) Int. Cl.
*A62B 1/02* (2006.01)
*A62B 35/00* (2006.01)

(52) U.S. Cl.
CPC ..... *A62B 1/02* (2013.01); *A62B 35/0006* (2013.01); *A62B 35/0037* (2013.01); *A62B 35/0043* (2013.01)

(58) Field of Classification Search
CPC .... A62B 1/02; A62B 1/04; A62B 1/06; A62B 1/14; A62B 1/16; A62B 35/0037; A63B 21/4001; A63B 21/4009; A63B 5/16
See application file for complete search history.

(56) References Cited

U.S. PATENT DOCUMENTS 50,596 A * 10/1865 Jones ..... E06C 9/14 182/101
279,186 A * 6/1883 Ricker ..... E06C 9/14 182/101
285,564 A * 9/1883 Brooks ..... A62L 31/10 182/47
296,769 A * 4/1884 Miller ..... A62B 1/06 182/112
2,567,278 A * 9/1951 Finocchiaro ..... A62B 1/02 182/11
3,871,480 A * 3/1975 Sauri ..... A62B 1/02 182/100
4,538,704 A * 9/1985 Forrest ..... A62B 1/02 182/10
6,029,771 A 2/2000 Keown
6,880,671 B2 * 4/2005 Raby ..... A62B 1/02 182/18
7,004,287 B1 * 2/2006 Barbara ..... A62B 1/00 182/70
7,159,693 B2 1/2007 Mettler
7,917,969 B2 * 4/2011 Iwasiuk ..... A62B 17/00 2/69
8,479,881 B2 * 7/2013 Gordon ..... A62B 1/02 182/3
2011/0036664 A1 * 2/2011 Peters ..... A62B 1/02 182/70
2011/0253477 A1 * 10/2011 Martin ..... E06C 9/14 182/76
2013/0240293 A1 9/2013 Wood

FOREIGN PATENT DOCUMENTS

CA 2574251 A1 7/2008

* cited by examiner

*Primary Examiner* — Colleen M Chavchavadze

(57) ABSTRACT

The fire escape device for a baby harness is a safety device that is adapted for use with an infant or toddler. The fire escape device for a baby harness is used to evacuate an infant or toddler from a building in an emergency. Specifically, the fire escape device for a baby harness is a dual line descending device that is used to lower an infant or toddler from an upper floor of a building to the ground. The fire escape device for a baby harness comprises an anchor apparatus, a full body baby harness, a plurality of attachment devices, and a plurality of descending devices.

10 Claims, 5 Drawing Sheets

FIRE ESCAPE DEVICE FOR A BABY HARNESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of firefighting and lifesaving devices, more specifically, a descending apparatus for lowering a baby in a baby harness from a building.

SUMMARY OF INVENTION

The fire escape device for a baby harness is a safety device that is adapted for use with an infant or toddler. The fire escape device for a baby harness is used to evacuate an infant or toddler from a building in an emergency. Specifically, the fire escape device for a baby harness is a dual line descending device that is used to lower an infant or toddler from an upper floor of a building to the ground.

These together with additional objects, features and advantages of the fire escape device will be readily apparent to those of ordinary skill in the art upon reading the following detailed description of the presently preferred, but nonetheless illustrative, embodiments when taken in conjunction with the accompanying drawings.

In this respect, before explaining the current embodiments of the fire escape device in detail, it is to be understood that the fire escape device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fire escape device.

It is therefore important that the claims be regarded as including such equivalent construction insofar as they do not depart from the spirit and scope of the fire escape device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
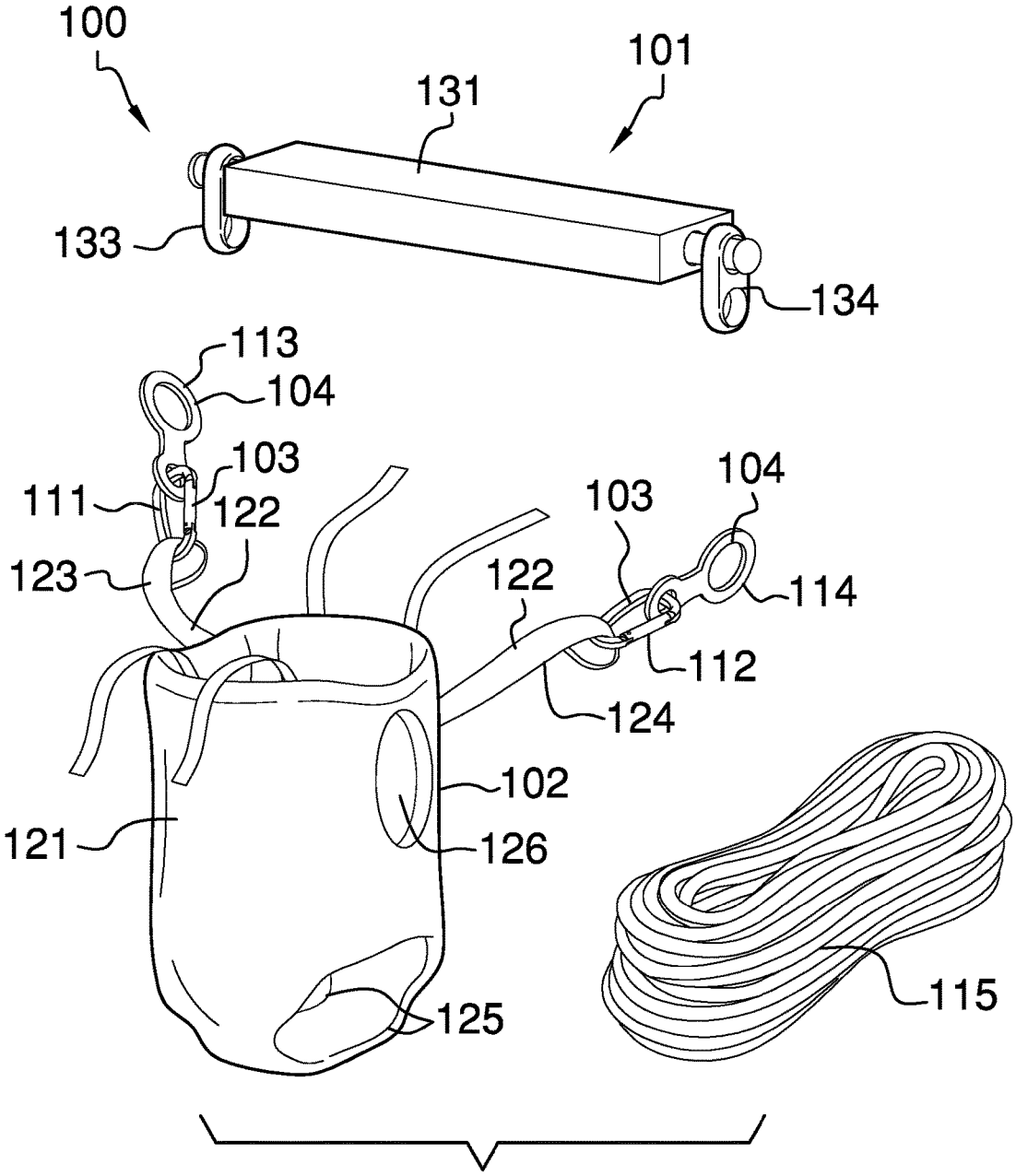
FIG. 1 is a perspective view of an embodiment of the disclosure.
Figure 2:
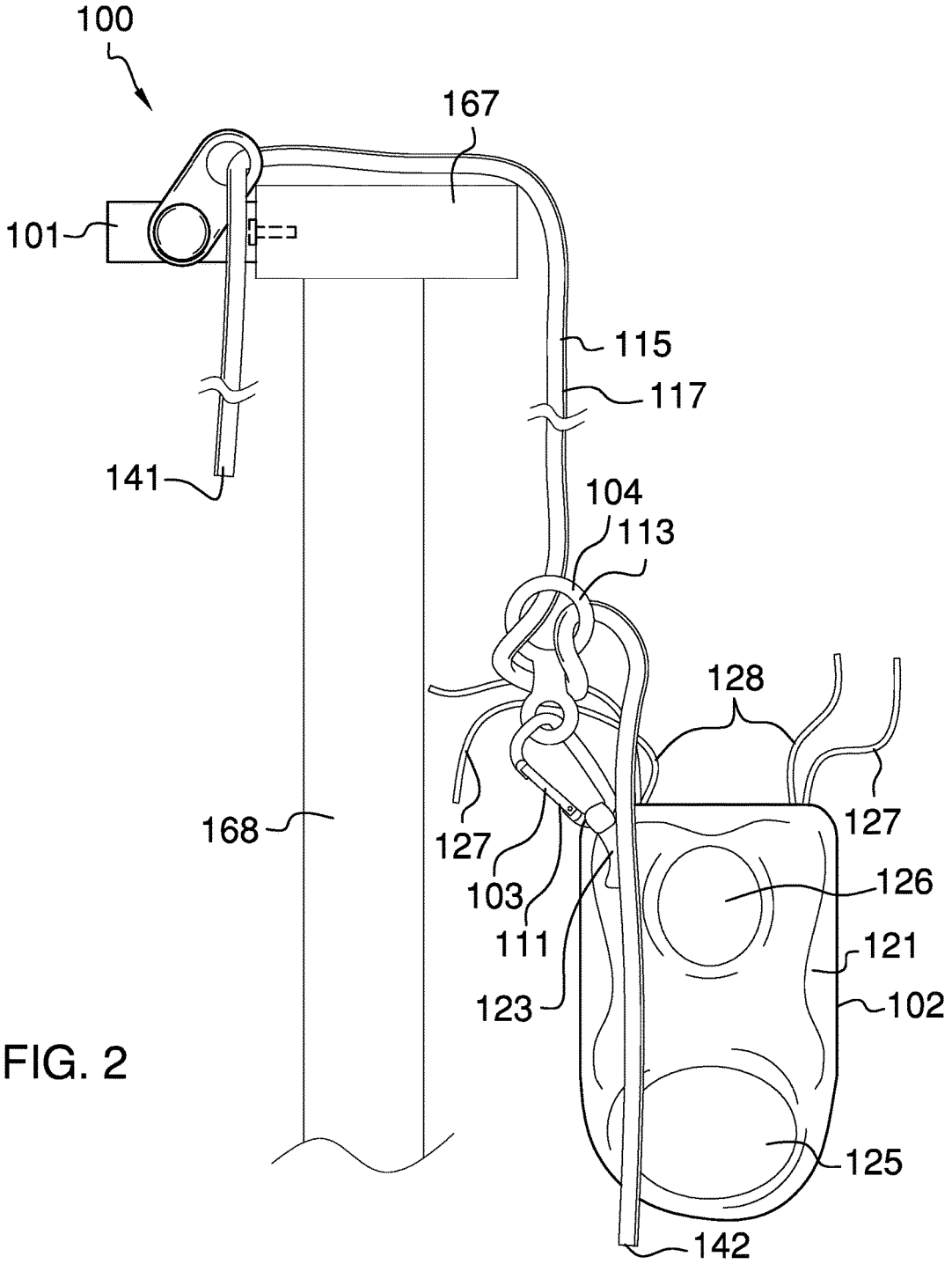
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a plurality of potential embodiments of the disclosure, which are illustrated in FIGS. 1 through 5.

The fire escape device for a baby harness 100 (hereinafter invention) comprises an anchor apparatus 101, a full body baby harness 102, a plurality of attachment devices 103, and a plurality of descending devices 104. The invention 100 is a lifesaving device that is adapted for use with an infant or toddler 161. The invention 100 is used to evacuate an infant or toddler 161 from a building 162 in an emergency. Specifically, the invention 100 is a dual line descending device that is used to lower an infant or toddler 161 from an upper floor of a building 162 to the ground 163.

The full body baby harness 102 is an apparel item that is designed to hold the infant or toddler 161 during the emergency rescue. The full body baby harness 102 comprises a garment 121 and a plurality of attachment loops 122. The garment 121 is designed to secure the infant or toddler 161 to the invention 100. As shown most clearly in FIGS. 2, 3, and 5, the garment 121 is essentially designed to be a bag that further comprises a plurality of leg holes 125 and a plurality of arm holes 126. During the emergency, the infant or toddler 161 is placed in the garment 121 such that the each leg 164 and arm 165 of the infant or toddler 161 goes through a leg hole selected from the plurality of leg holes 125 and an arm hole selected from the plurality of arm holes 126 respectively. In a second potential embodiment of the disclosure, a first shoulder strap 127 and a second shoulder strap 128 are incorporated into the garment 121 to insure that the infant or toddler 161 remains in the garment 121 should a failure in the lowering process result in the infant or toddler 161 become inverted.

In the first potential embodiment of the disclosure and the second potential embodiment of the disclosure, the garment 121 is formed from a fabric made of material selected from the group consisting of ballistic nylon or ballistic polyester. Methods to form garments as described in this paragraph are well known and documented in the textile arts. As shown most clearly in FIGS. 2 and 4, each of the plurality of attachment loops 122 is a looped webbing that is sewn to the garment 121. In the first potential embodiment of the disclosure and the second potential embodiment of the disclosure, each of the plurality of attachment loops 122 is attached to the garment 121 using sewn seam. Methods to attach loops of webbing to a garment using sewn seams are well known and documented in the textile arts.

Figure 3:
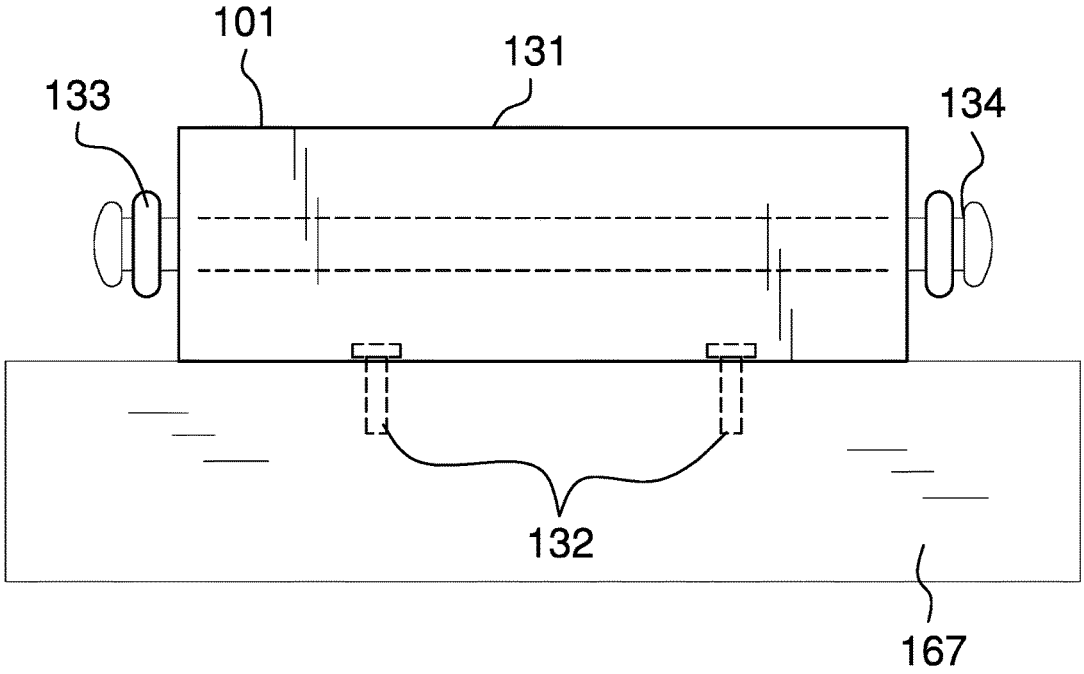
FIG. 3 is a top view of an embodiment of the disclosure.
Figure 4:
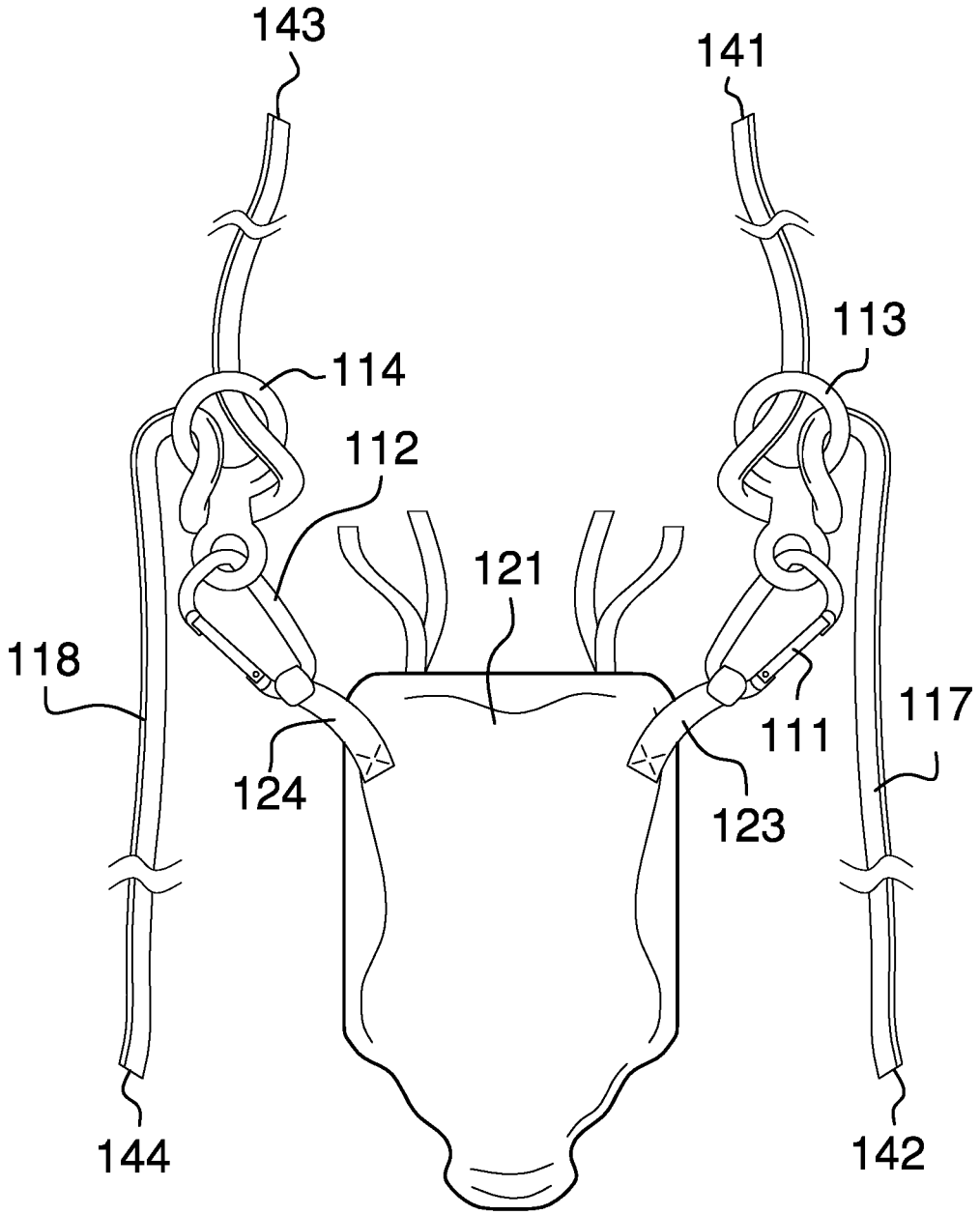
FIG. 4 is an in use view of an embodiment of the disclosure.
Figure 5:
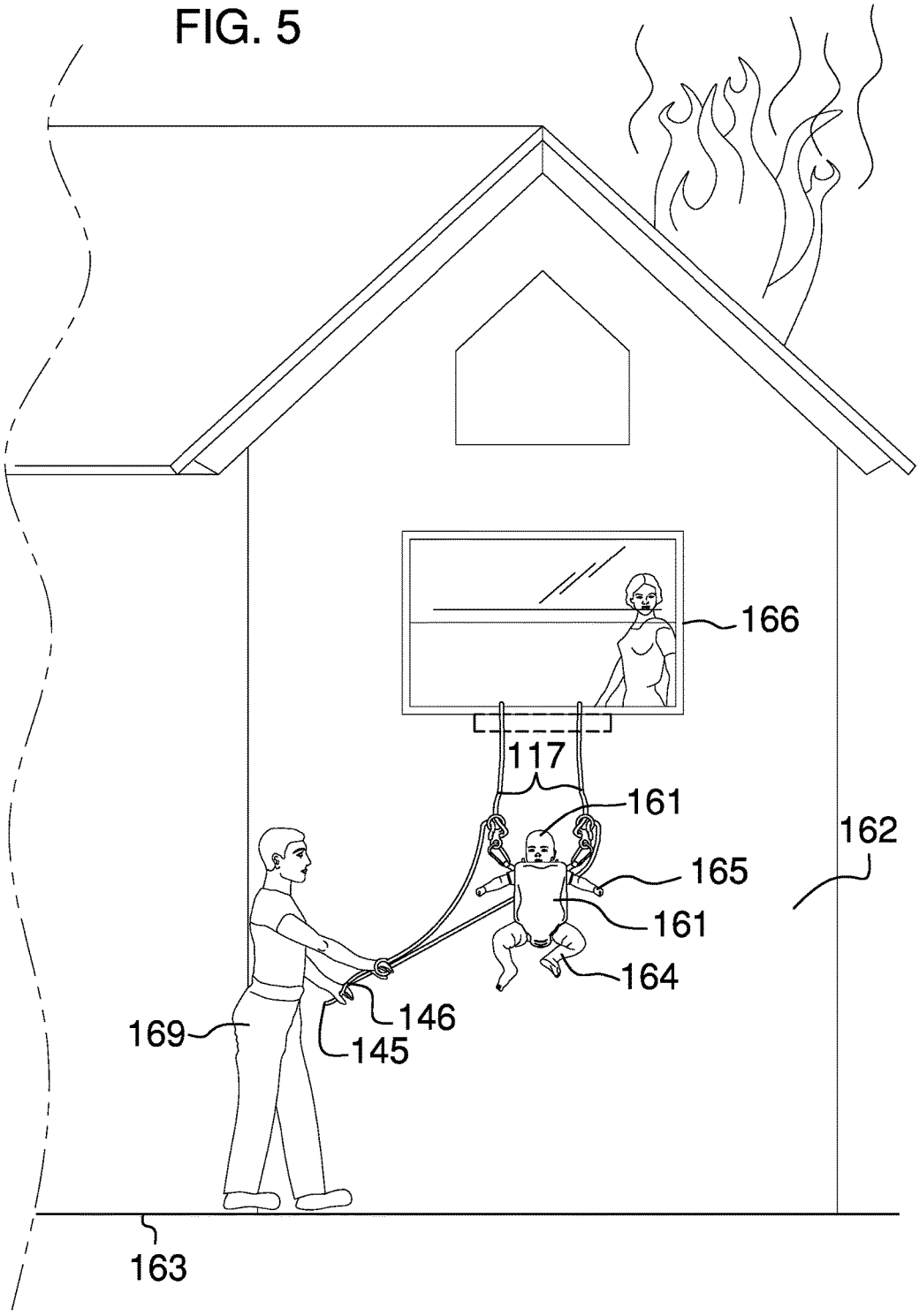
FIG. 5 is an in use view of an embodiment of the disclosure.

The anchor apparatus 101 comprises a base 131, a plurality of anchor bolts 132, a first surface anchor 133 and a second surface anchor 134. The base 131 attaches the invention 100 to the frame 168 of a building 162 and to the bear the weight of the person or object being lowered with the invention 100. The base 131 is attached to the frame 168 of the building 162 by a window 166 and is attached through the window sill 167. As shown in FIG. 3, the base 131 is attached to the window sill 167 using a plurality of anchor bolts 132. The base 131 is formed in the shape of a rectangular block and is made of a cast or forged metal. Suitable metals include, but are not limited to, iron or steel. Methods to make a base and anchor the base to an object are well known and documented in the mechanical arts.

The first surface anchor 133 and the second surface anchor 134 are attached to the base 131. The first surface anchor 133 is a commercially available anchor in the form of a ring that is attached to the base 131. The second surface anchor 134 is a commercially available anchor in the form of a ring that is attached to the base 131. The surface of the base 131 from which the second surface anchor 134 projects is the surface of the base 131 that is distal to the surface of the base 131 from which the first surface anchor 133 projects. The purpose of the first surface anchor 133 and the second surface anchor 134 is to secure one or more ropes 115 to the base 131. Methods to attach surface anchors to metal blocks are well known and documented in the mechanical arts and would include techniques such as welding. Alternatively, the first surface anchor 133 and the second surface anchor 134 may be incorporated into the casting or forging of the base 131. The use of the first surface anchor 133 and the second surface anchor 134 are discussed elsewhere in this disclosure.

Each of the plurality of descending devices 104 is a commercially available device that is used in high angle climbing and rescue situations that is designed to place friction on a climbing rope or line such that the friction can be used to control the rate of descent of a person or object attached to the descending device. The selection and use of descending devices is well known among those skilled in high angle climbing and rescue.

Each of the plurality of attachment devices 103 is a commercially available device that used to attach a descending device selected from the plurality of descending devices 104 to an attachment loop selected from the plurality of attachment loops 122.

In the first potential embodiment of the disclosure and the second potential embodiment of the disclosure: 1) the plurality of attachment devices 103 comprises a first carabiner 111 and a second carabiner 112; 2) the plurality of descending devices 104 comprises a first FIG. 8 descender 113 and a second FIG. 8 descender 114 and, 3) the plurality of attachment loops 122 further comprises a first attachment loop 123 and a second attachment loop 124.

To use first potential embodiment of the disclosure or the second potential embodiment of the disclosure after the invention 100 has been anchored to the frame 168 or window sill 167, one or more ropes 115 have to be threaded through the invention 100. Each of the one or more ropes 115 is a commercially available climbing rope or line. In the first potential embodiment of the disclosure and the second potential embodiment of the disclosure, the one or more ropes 115 further comprises a first climbing line 117 and a second climbing line 118. The first climbing line 117 is further defined with a first working end 141 and a first standing end 142. The second climbing line 118 is further defined with a second working end 143 and a second standing end 144.

To set up the descending apparatus, the first working end 141 of the first climbing line 117 is secured to the first surface anchor 133. The second working end 143 of the second climbing line 118 is secured to the second surface anchor 134. The first working end 141 of the first climbing line 117 and the second working end 143 of the second climbing line 118 can be secured using a variety of methods including, but not limited to: 1) belaying with a knot; 2) threading the working end of the line through the surface anchor and terminating the working end of the line with a stopper knot; or 3) terminating the working end of the line with a readily and commercially available line stopper (also known as a winch stopper).

The bight of first climbing line 117 is inserted and threaded through the first FIG. 8 descender 113 as normal. The bight of second climbing line 118 is inserted and threaded through the second FIG. 8 descender 114 as normal. Methods to insert climbing ropes or lines through FIG. 8 descenders are well known and documented in the high angle climbing and rescue art. The first FIG. 8 descender 113 is attached to the first attachment loop 123 using the first carabiner 111. The second FIG. 8 descender 114 is attached to the second attachment loop 124 using the second carabiner 112. The infant or toddler 161 is then placed in the full body baby harness 102. The first standing end 142 and the second standing end 144 are then dropped to the ground 163. Rescue personnel 169 located on the ground 163 then place tension on the first climbing line 117 and the second climbing line 118 as the infant or toddler 161 is lowered out of the window 166. By controlling the tension on the first climbing line 117 and the second climbing line 118 rescue personnel 169 can control the rate of descent of the infant or toddler 161 until the infant or toddler 161 reaches the ground 163.

A third potential embodiment of the disclosure is identical to the first potential embodiment of the disclosure with the modification that the second climbing line 118 is eliminated from this scenario. In the third potential embodiment of the disclosure, the first climbing line 117 is further defined with a third standing end 145 (which was the first working end 141 of the first potential embodiment of the disclosure) and a fourth standing end 146 (which was the first standing end 142 of the first potential embodiment of the disclosure). In this scenario, the third standing end 145 is threaded through the first surface anchor 133 and the fourth standing end 146 is threaded through the second surface anchor 134. This configuration eliminates the need to physically secure the first climbing line 117 to the anchor apparatus 101 with a knot or other device.

A fourth potential embodiment of the disclosure replaces the garment 121 used in the third potential embodiment of the disclosure with the garment 121 used in the second potential embodiment of the disclosure.

The following definitions were used in this disclosure:

Belay: As used in this disclosure, to belay means to secure a person or object to a rope or line.

Bight: As used in this disclosure, a bight refers to any central location on a rope or line.

Carabiner: As used in this disclosure, a carabiner is coupling link that is usually formed as an oblong metal ring with one spring hinged side that is used to open and close the ring. Synonyms for carabiner include D-link.

FIG. 8 Descender: As used in this disclosure, a FIG. 8 descender is a commercially available device used for high angle climbing and rescue purposes. The FIG. 8 descender is used to put friction on a climbing rope or line to control the rate of speed of a descent.

Knot: As used in this disclosure, a knot is an interlacement of cord, ribbon, rope, or similar materials that is used to: 1) secure the cord, ribbon, rope, or other similar material to an object which may include, but is not limited to, a second cord, ribbon, rope, or other similar material; or, 2) prevent the cord, ribbon, rope, or other similar material from being pulled through a hole or out of a retaining device. In this disclosure, the second type of knot is referred to as a stopper knot.

Sewn Seam: As used in this disclosure, a sewn seam a method of attaching two or more layers of textile, leather, or other material through the use of a thread, a yarn, or a cord that repeatedly inserted and looped through the two or more layers of textile, leather, or other material.

Standing End: As used in this disclosure, the standing end refers to the end of a rope or line that is not involved with a knot. The standing end is usually the end opposite the working end of a rope or line.

Strip: As used in this disclosure, the term describes a long thin object of uniform width. Strips are often rectangular in shape.

Textile: As used in this disclosure, a textile is a material that is woven, knitted, braided or felted. Synonyms in common usage for this definition include fabric and cloth.

Toddler: As used in this disclosure, a toddler is a human child between the ages of one and three who has learned to walk.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Working End: As used in this disclosure, the working end refers to the end of a rope or line that forms a knot. The working end is usually the end opposite the standing end of a rope or line.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lifesaving device comprising:

an anchor apparatus, a full body baby harness, a plurality of attachment devices, and a plurality of descending devices;

wherein the lifesaving device is adapted for use with an infant or toddler;

wherein the lifesaving device is configured to evacuate an infant or toddler from a building;

wherein the lifesaving device is a dual line descending device, comprising one or more ropes, that is configured to lower an infant or toddler from an upper floor of a building to the ground;

wherein the full body baby harness comprises a garment and a plurality of attachment loops;

wherein the garment further comprises a plurality of leg holes and a plurality of arm holes;

wherein the plurality of arm holes and the plurality of leg holes of the garment are configured to receive the arms and legs of the infant or toddler;

wherein each of the plurality of attachment loops is attached to the garment using sewn seam;

wherein the anchor apparatus comprises a base, a plurality of anchor bolts, a first surface anchor and a second surface anchor;

wherein the base is attached a building using the plurality of anchor bolts;

wherein the base is formed in the shape of a rectangular block;

wherein the base is made of metal using a method selected from the group consisting of casting or forging;

wherein the first surface anchor is a ring;

wherein the second surface anchor is a ring;

wherein the first surface anchor is attached to the base;

wherein the second surface anchor is attached to the base;

wherein each of the plurality of descending devices provide friction on a climbing rope or line;

wherein each of the plurality of attachment devices is used to attach a descending device selected from the plurality of descending devices to an attachment loop selected from the plurality of attachment loops.

2. The lifesaving device according to claim 1 wherein the plurality of attachment devices comprises a first carabiner and a second carabiner.

3. The lifesaving device according to claim 2 wherein the plurality of descending devices comprises a first FIG. 8 descender and a second FIG. 8 descender.

4. The lifesaving device according to claim 3 wherein the plurality of attachment loops is further defined as a first attachment loop and a second attachment loop.

5. The lifesaving device according to claim 4 wherein the one or more ropes comprises a first climbing line;

wherein the first climbing line is further defined with a first standing end and a second standing end;

wherein the first standing end is threaded through the first surface anchor;

wherein the second standing end is threaded through the second surface anchor;

wherein the first standing end is lowered to the ground;

wherein the second standing end is lowered to the ground;

wherein a first bight of the first climbing line is inserted in the first FIG. 8 descender;

wherein a second bight of the first climbing line is inserted in the second FIG. 8 descender;

wherein the first FIG. 8 descender is attached to the first attachment loop using the first carabiner;

wherein the second FIG. 8 descender is attached to the second attachment loop using the second carabiner.

6. The lifesaving device according to claim 5 wherein the garment further comprises a first shoulder strap;

wherein the garment further comprises a second shoulder strap.

7. The lifesaving device according to claim 6 wherein the garment is formed from a material selected from the group consisting of ballistic nylon or ballistic polyester.

8. The lifesaving device according to claim 4 wherein the one or more ropes comprises a first climbing line and a second climbing line;

wherein the first climbing line is further defined with a first working end and a first standing end;

wherein the second climbing line is further defined with a second working end and a second standing end;

wherein the first working end is secured to the first surface anchor;

wherein the second working end is secured to the first surface anchor;

wherein the first standing end is lowered to the ground;

wherein the second standing end is lowered to the ground;

wherein a first bight of the first climbing line is inserted in the first figure eight descender;

wherein a second bight of the second climbing line is inserted in the second FIG. 8 descender;

wherein the first FIG. 8 descender is attached to the first attachment loop using the first carabiner;

wherein the second FIG. 8 descender is attached to the second attachment loop using the second carabiner.

9. The lifesaving device according to claim 8 wherein the first working end is secured to the first surface anchor using a method selected form the group consisting of 1) belaying with a knot; 2) threading the working end of the line through the surface anchor and terminating the working end of the line with a stopper knot; or 3) terminating the working end of the line with a winch stopper, wherein the first working end is secured to the first surface anchor using a method selected form the group consisting of 1) belaying with a knot; 2) threading the working end of the line through the surface anchor and terminating the working end of the line with a stopper knot; or 3) terminating the working end of the line with a winch stopper.

10. The lifesaving device according to claim 9 wherein the garment further comprises a first shoulder strap;

wherein the garment further comprises a second shoulder strap;

wherein the garment is formed from a material selected from the group consisting of ballistic nylon or ballistic polyester.

* * * * *